US005548081A

United States Patent [19]

Rost

[11] Patent Number: 5,548,081

[45] Date of Patent: Aug. 20, 1996

[54] DUCT, PARTICULARLY FOR HIGH VOLTAGES WITH SPECIAL ELECTRODE HOLDER

[75] Inventor: Peter Rost, Hamburg, Germany

[73] Assignee: Kommandidgesellschaft Ritz Messwandler GmbH & Co., Hamburg, Germany

[21] Appl. No.: 159,789

[22] Filed: Nov. 30, 1993

[30] Foreign Application Priority Data

Nov. 30, 1992 [DE] Germany ..... 42 40 118.6

[51] Int. Cl.[6] ..... H01B 9/06

[52] U.S. Cl. ..... 174/14 BH; 174/256; 174/138 G; 220/422

[58] Field of Search ..... 174/14 BH, 15.3, 174/176-F, 256, 28, 29, 30, 50.63, 137 R, 138 G, 148, 154, DIG. 10, 152 R; 210/243; 220/421, 422, 426; 336/84 C

[56] References Cited

U.S. PATENT DOCUMENTS

| | | | |
|---|---|---|---|
| 1,935,228 | 11/1933 | Kopeliowitsch | 218/118 |
| 2,306,186 | 12/1942 | Rankin | 218/53 |
| 2,438,347 | 3/1948 | Morin | 174/28 |
| 2,597,867 | 5/1952 | Hansen | 333/81 A |
| 3,629,486 | 12/1971 | Tadworth | 174/16.2 |
| 3,716,652 | 2/1973 | Lusk et al. | 174/15.3 |
| 3,819,845 | 6/1974 | Tahiliani | 174/11 R |
| 3,911,937 | 10/1975 | Sletten et al. | 134/1 |
| 3,973,077 | 8/1976 | Classon | 174/15.3 |
| 4,159,401 | 6/1979 | Kamata | 174/31 R |
| 4,424,402 | 1/1984 | Murase | 174/15.3 |
| 4,523,052 | 6/1985 | Takahashi et al. | 174/15.3 |
| 4,731,599 | 3/1988 | Preissinger | 336/84 C |
| 4,774,385 | 9/1988 | Toshima | 174/142 |
| 4,956,903 | 9/1990 | Thuries | 29/631 |

FOREIGN PATENT DOCUMENTS

| | | |
|---|---|---|
| 347086 | 4/1923 | Germany . |
| 1198888 | 8/1965 | Germany . |
| 1800667 | 5/1969 | Germany . |
| 2205035 | 8/1973 | Germany . |
| 2800208 | 11/1978 | Germany . |
| 3616243 | 12/1988 | Germany . |

OTHER PUBLICATIONS

"Autonome Wandler MIT $SF_6$–Isolation", Friedrich, M., Faltermeier, F., Mar. 8, 1986, pp. 256–260.

*Primary Examiner*—Kristine L. Kincaid
*Assistant Examiner*—Christopher Horgan
*Attorney, Agent, or Firm*—Michael J. Striker

[57] ABSTRACT

A duct for connecting an electrical device insulated with gas with a terminal location located in atmospheric air, the duct has a gas filled bushing insulator, at least one tubular field control electrode located inside the bushing insulator, at least one insulating tube having an end facing a potential-guiding region of the duct, the at least one field control electrode being formed by a conducting portion on the end of the at least one insulating tube, a bushing conductor around which the at least one insulating tube is arranged coaxially, the insulating tube having a ground potential-side end, and a holder which holds the insulating tube at the ground potential-side end outside a region loaded with high field intensity.

17 Claims, 4 Drawing Sheets

DUCT, PARTICULARLY FOR HIGH VOLTAGES WITH SPECIAL ELECTRODE HOLDER

BACKGROUND OF THE INVENTION

The present invention relates to a duct, in particular for high voltages, for connecting an electrical device isolated with gas, for example a transformer, a throttle coil, a measuring transformer, a capacitor or a switching device, with a connecting part located in atmospheric air, with at least one tubular field control electrode inside a gas-filled bushing insulator.

Such a duct is disclosed for example in the German document DE-PS 36 16 243. In this duct a cylindrical control capacitor composed of several control electrodes surrounds a cylindrical conductor. The capacitor is mounted with its lower electrode on a flange so that it forms a first chamber in its interior which is filled with sulfurhexafluoride ($SF_6$) under high pressure as insulating gas. A second chamber is located outside of the capacitor and filled with the same gas under lower pressure. This known gas insulating duct has an explosion-protective construction in which the bushing insulator composed of porcelain is not directly subjected to the high pressure as long as the seal between the electrode and the capacitor and the individual electrodes relative to electrically insulated perforated discs maintain the overpressure of the gas.

The control electrodes are surrounded at both ends by ring-shaped connection electrodes and mounted by means of conical perforated discs on cast resin directly on one another so that a creep path extending cone is produced and no creep discharge due to the available potential difference occurs.

The known duct has a disadvantage that for avoiding creep discharge complicated holders of the control electrodes are needed. Since the distance between the high voltage electrode and the control electrode is bridged by insulating material, the space of the duct loaded with high field intensity no longer provides for legal requirements for a pure gas insulation and relatively great distances between the electrodes are required.

The German reference DE 28 00 208 describes a "Ceramic Sleeve Insulator with Pressure Gas Filling, in Particular for Electrical Devices and Apparatuses". This sleeve insulator is provided in its interior with a gas permeable sleeve which contains in its interior a pressure gas filler and during bursting of porcelain sleeve must prevent damages to the surrounding area. The sleeve insulator is mounted on a plate gas tightly and surrounds a control electrode which is also mounted there, through which a conductor rod extends in a housing under the plate. The conductor rod extends further at the upper end of the sleeve insulator through a further plate to the exterior.

The German reference DE 11 98 888 discloses a "High Voltage Duct" in which a current conductor is guided in an insulating hollow body which is filled with gaseous or liquid insulating material and the field distribution is influenced by an electrode which is conductively connected with a grounded frame and circularly surrounds the bushing conductor in the insulating body. The insulating hollow body composed of two parts, together with metal tubes, is connected with the grounded frame. First ring electrodes are located at the ends of the,metal tube, and second ring electrodes conductively connected with the bushing conductor are located opposite to the first ring electrodes. By the arrangement of this ring electrode pair and the shape of the insulating hollow body, the stresses in the axial direction must be favorably influenced.

The German document DE 37 40 86 describes an "Electrical Bushing Insulator" in which the electrodes are formed as metal coating on insulating bodies. Moreover, the German document DE 22 05 035 discloses mounting of a conductive coating on the surface of cylindrical insulating parts for forming electrodes in this manner.

The German document DE 18 00 667 finally describes a "Free Air-Duct with Pressure Gas Filling for High Voltage" which has a multi-part ceramic casing with control electrodes which is held by ring discs gas tightly clamped by neighboring parts of the casing (sleeve insulator). The control electrodes are arranged concentrically around a tubular conductor. The geometric shape and the position of the control electrodes is selected so that the potential distribution on the surface of the duct is at least approximately linear.

The disadvantage of this construction is however that the ring discs in this arrangement are not located in a field-poor region so that no pure gas insulation is provided in the highly stressed region. Since the ring discs are connected further with (metallic) screws for mounting on the casing parts with one another, the potential of the corresponding control electrode is drawn to the insulator surface, so that it is placed under a high stress.

SUMMARY OF THE INVENTION

Accordingly, it is an object of the present invention to provide a duct of the above mentioned general type, which has small size and a substantially improved operational safety, in particular rupturing strength.

In keeping with these objects and with others which will become apparent hereinafter, one feature of the present invention resides, briefly stated, in a duct of the above mentioned type, which has at least one field control electrode formed by conductive portions of at least one insulating tube at an end facing the potential-guiding region of the duct, and at least one insulating tube is arranged coaxially around at least one bushing conductor and held by at least one holder on its ground potential-side end outside the region loaded with high field intensity.

When the duct is designed in accordance with the present invention, it corresponds to the legal requirements of the gas insulation and is especially operation safe. An especial advantage of this solution is that during temperature fluctuations the field control electrodes can freely change their length without causing mechanical stresses or friction effect between the electrodes. Since the holders are arranged in approximately potential free region, there is no danger of creep discharges.

The holders of the insulating tube are formed preferably by an insulating disc. Each holder can be formed by two individual holders spaced from one another.

When the holders are formed as flat discs of insulating material and preferably have single openings, a manufacture-favorable shape is obtained, and the material and cost of manufacture are saved. The openings permit drying and impregnation in the space between insulating discs.

In accordance with a further feature of the invention, the insulating tubes are held preferably with the holders on a supporting tube which coaxially surrounds the bushing conductor.

Since the insulating tubes are held by the holders on the centrally arranged supporting tube, the control electrodes are mounted in specially accurate positions. Alternatively, the concentric insulating tubes can be mounted on one another by spacer rings which basically provide greater position tolerances, since manufacturing tolerances are added.

A favorable construction is obtained when the insulating tubes are longer than the control electrodes, and preferably the insulator tube with the greater diameter (first insulator tube) is longer than the tube with a smaller diameter (second insulating tube).

Since a conical mounting ring fixed on the supporting tube is provided on the holders and engages in a corresponding opening of the corresponding holder, a fixation of the insulating tube is possible in the axial direction and the control electrodes can be mounted very simply.

In accordance with a further feature of the present invention, the distance of the equipotential lines can be favorably influenced when the control electrodes are provided with a bead-shaped end.

The advantages of the inventive construction are especially noticeable when the maximum operational voltage is 250 kV or more.

Still a further feature of the present invention is that the field control electrodes operate for example as intermediate potential-control electrodes.

The gas which is utilized in the inventive duct can be a sulfurhexafluoride ($SF_6$) or another gas with similar insulating properties. The gas can be held under increased pressure.

The field control electrodes can be formed on the insulating tubes by a metallization. Finally, the duct can be utilized in current, voltage or combination transformers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
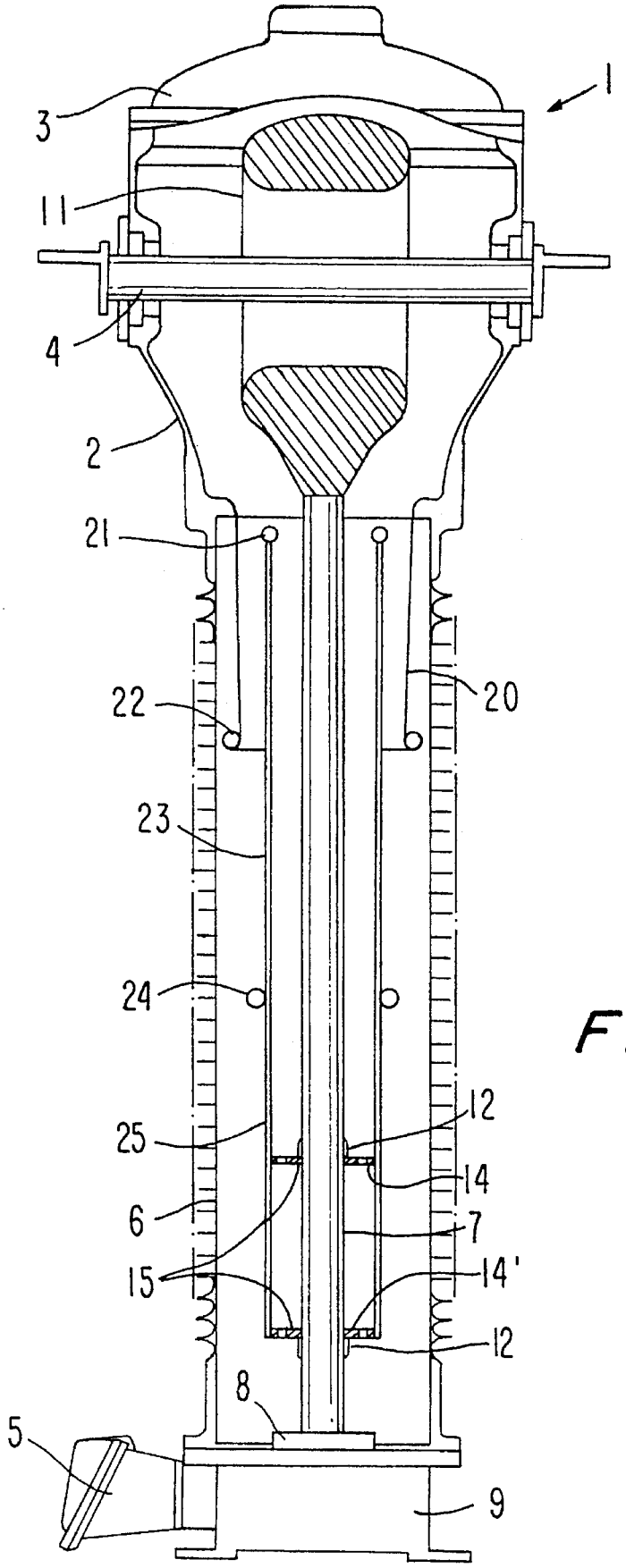
FIG. 1 is a view showing a first embodiment of a duct in accordance with the present invention, in a partially sectioned housing view of a current transformer for high voltage with a control electrode.

FIG. 1 shows a measuring transformer which is identified with reference numeral 1 and has an upper housing head 2 provided with a cover 3 and formed as aluminum cast housing and a current conductor 4 in the region of the potential.

The current conductor 4 is enclosed in the interior of the housing head 2 by a core of the measuring transformer 1, and its core screening is identified with reference numeral 11. A current conductive connection from the coil of the measuring transformer 1 is provided by means of the inventive duct to an outer part located in atmospheric air, for example to a terminal box 5 which is mounted in a base 9 which is under ground potential. The potential difference between the housing head 2 and the base 9 located under ground potential is bridged by a bushing insulator 6 which forms a gas-tight space together with the housing head 2, the housing cover 3 and the base 9. The gas-tight space is filled preferably with sulfurhexafluoride ($SF_6$) as insulating gas and can be under pressure in order to increase the insulating action.

The housing head 2 extends further downwardly into the region of the bushing insulator 6 with a high voltage electrode 20, whose bead-shaped end is identified with 22. A first field control electrode 23 is arranged concentrically to the high voltage electrode 20, and its upper end is identified with 21 while its lower end identified with 24. The ends 21, 24 are also bead-shaped for avoiding local field intensity increase.

The first field control electrode 23 is formed as a conductive layer on a first insulating tube 25 composed of insulating material. It is held at one side only on its lower end by two first insulating discs 14 and 14' on a supporting tube 7 which surrounds the bushing conductor, and located in approximately potential-free space. Due to the distance between the two first insulating discs 14 and 14' a mechanically high clamping length is obtained which provides a corresponding robust holding of the first insulating tube 26. The first insulating discs 14 and 14' are connected fixedly with the first insulating tube 25. The insulating discs are fixed axially on the supporting tube 7 by conical mounting rings 12 which engage in corresponding recesses of the first insulating discs 14 and 14'. At the side of the ground potential, the supporting tube 7 is fixed on the base 9 by a mounting part 8. Thereby the first field control electrode 23 which partially envelops the first insulating tube 25 is mounted on the lower end by the first insulating disc 14, 14' on the supporting tube 7. In conduction of alternating temperatures, the first insulating tube 25 can therefore freely expand upwardly. The positioning of the first field control electrodes 23 is performed outside the region loaded with high field intensity on the high voltage electrode 20. For this region a pure gas insulation is provided with especially high field intensities.

The first insulating discs 14 and 14' are provided with openings 15. The openings permit an easier drying and impregnation of the space between the insulating discs.

Figure 2:
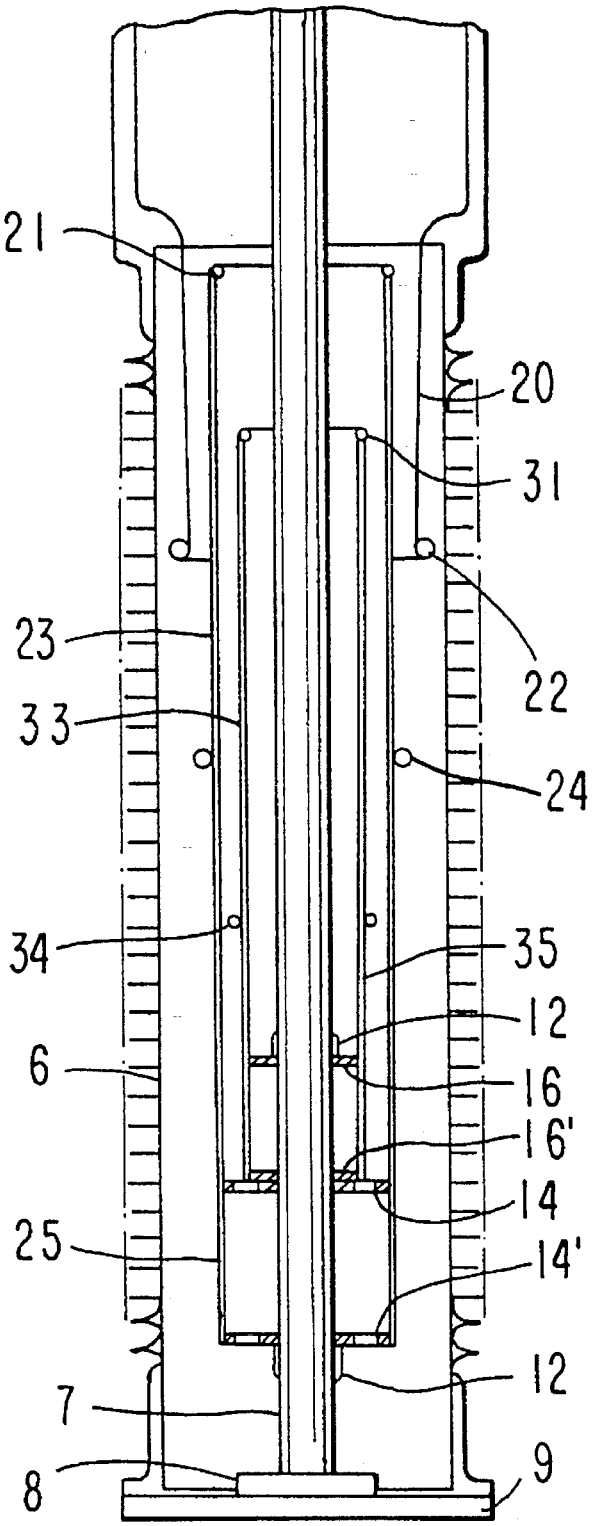
FIG. 2 is a view showing a second embodiment of the inventive duct in a partially sectioned housing view of a current transformer with two control electrodes.

In the embodiment shown in FIG. 2 the same parts are identified with the same reference numerals. In deviation from the embodiment of FIG. 1, the high voltage measuring transformer of FIG. 2 has a second field control electrode 33 which has an upper end identified with 31 and a lower end identified with 34. The second field control electrode 33 is applied as a metallically conductive layer on a second insulating tube 35. The second insulating tube 35 is mounted as the first insulating tube 25, on the supporting tube 7 by two insulating discs 16 and 16' on its lower end. Since the lower second insulating disc 16' of the further inwardly located second field control electrode 33 and the upper first insulating disc 14 of the further outwardly located first field control electrode 23 abut directly against one another, the axial fixation of both insulating tubes by only two conical mounting rings 20 is obtained.

In the shown case the insulating tubes 25, 35 are telescopically inserted in one another, so that the first insulating tube 25 for the first field control electrode 23 with the greater diameter is formed longer than the second insulating tube 35 for the second field control electrode 33 with the smaller diameter.

Figure 3:
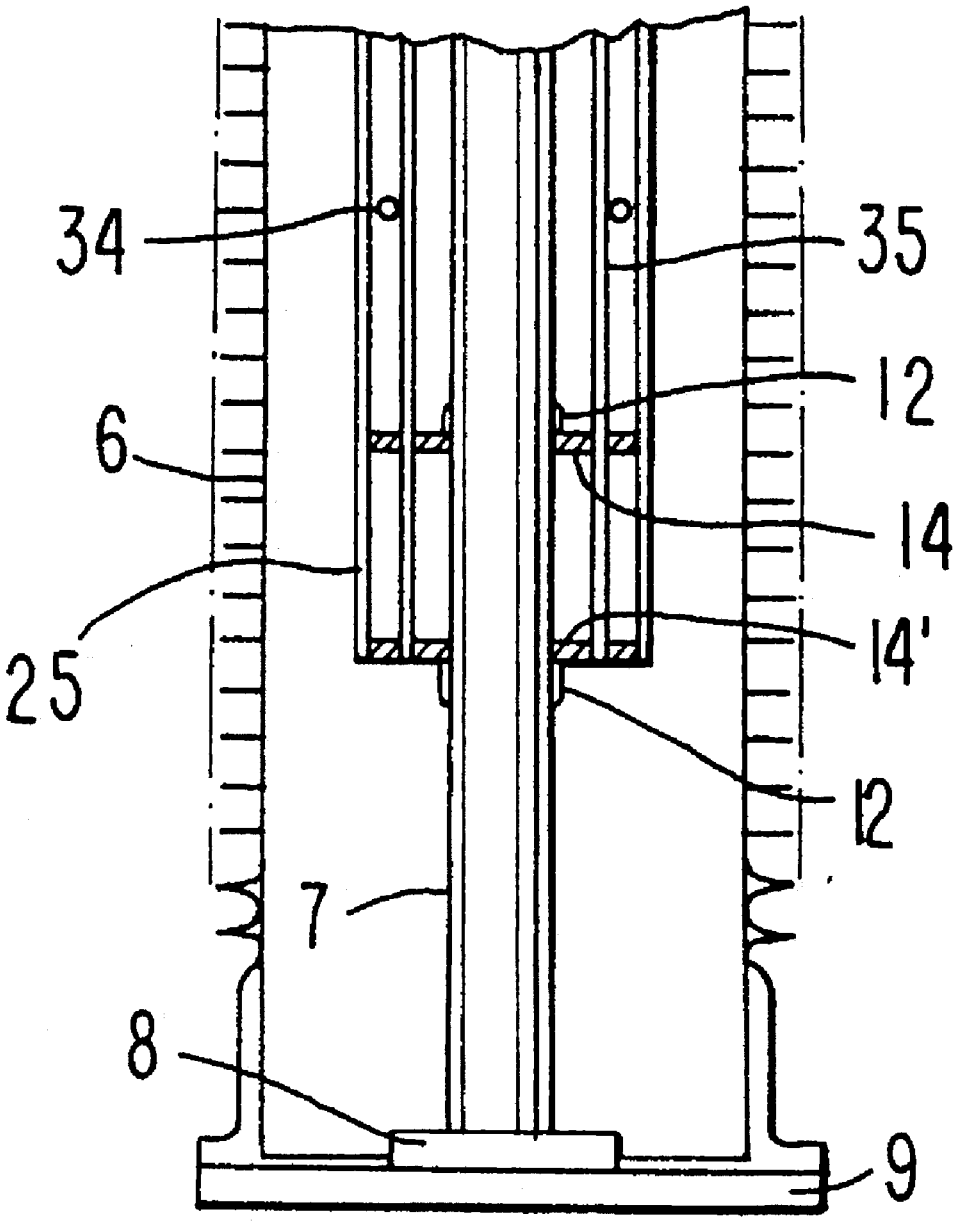
FIG. 3 is a view showing a lower portion of a third embodiment of the inventive duct.

In the third embodiment shown in FIG. 3, the inner second insulating tube 35 extends in the axial direction to the lower end of the first insulating tube 25. In this case the first insulating discs 14 and 14' operate as joint holders for both insulating tubes, and the conical mounting ring 12 serves again for actual fixation of the insulating discs.

It is to be understood that also further control electrodes can be provided as well. By increasing the number of the control electrodes, the diameter and the length of the bushing insulator, which for example is produced of glass fiber-reinforced synthetic plastic material, can be further reduced, or with the same size can provide the duct for higher voltage region.

Figure 4:
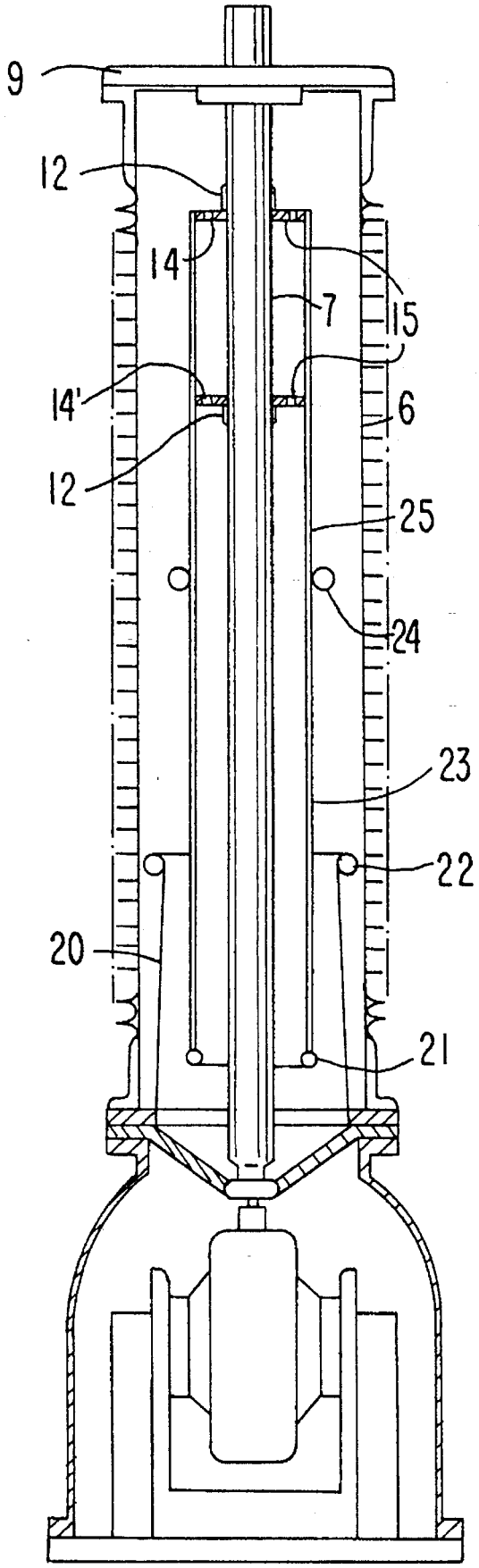
FIG. 4 is a view showing a fourth embodiment of the inventive duct.

FIG. 4 shows a fourth embodiment of the present invention. In deviation from the embodiments of FIGS. 1–3 which show current transformers, the embodiment of FIG. 4 is a voltage transformer. In this embodiment also a supporting pipe 7 is provided, which can contain a bushing conductor and is surrounded by the first insulating tube 25. The field control electrode 23 is mounted on the end of he insulating tube which faces the potential guiding region. Its potential-side end is identified with 21 and its end facing away of the potential is identified with 24. The insulating tube is further arranged coaxially around the supporting tube 7 and held by the insulating discs 14, 14' (holders) on the ground potential-side end on the supporting tube 7. For axial fixation of the insulating discs, two mounting rings 12 are provided again. Also, int his embodiment the high voltage electrode 20 is arranged coaxially to the field control electrode 23. The ground potential-side end of the duct is closed by the base 9.

In this embodiment also several insulating tubes can be arranged concentrically with the field control electrodes, as shown in FIG. 2.

The inventive constructions have special high advantages when compared with known ducts for voltage regions over 250 kV, preferably over 400 kV. Due to the inventive construction a duct is provided with a gas insulation which avoids the disadvantages of the mixture insulation, in particular the danger of creep discharges on the spacer insulators. The operation safety of this duct is also advantageously increased.

The description of the invention is presented with respect to the current transformers shown in the drawings. The invention can be of course utilized also for voltage transformers as well.

It will be understood that each of the elements described above, or two or more together, may also find a useful application in other types of constructions differing from the types described above.

While the invention has been illustrated and described as embodied in a duct for connection of an electrical device insulated with gas, with a terminal location located in atmospheric air, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A duct for connecting an electrical device insulated with gas with a terminal location located in atmospheric air, the duct comprising a gas filled bushing insulator; at least one tubular field control electrode located inside said bushing insulator; at least one insulating tube having an end facing a potential-guiding region of the duct, said at least one field control electrode being formed by a conducting portion on said end of said at least one insulating tube; a bushing conductor around which said at least one insulating tube is arranged coaxially, said at least one insulating tube having a ground potential-side end; and a holder which holds said insulating tube at said ground potential-side end outside a region loaded with high field intensity, said at least one insulating tube being formed longer than said at least one field control electrode.

2. A duct as defined in claim 1, wherein said holder of said at least one insulating tube is formed as an insulating disc.

3. A duct as defined in claim 1, wherein said holder is formed by two holding elements which are spaced from one another.

4. A duct as defined in claim 1, wherein said holder is formed as a flat disc composed of an insulating material and having openings.

5. A duct as defined in claim 1, wherein said at least one field control electrode has a bead-shaped end.

6. A duct as defined in claim 1, wherein said duct is formed so as to provide a maximum operational voltage of 250 kV.

7. A duct as defined in claim 1, wherein said duct is, formed so as to provide a maximum operational voltage of more than 250 kV.

8. A duct as defined in claim 1, wherein said gas is a sulfurhexafluoride.

9. A duct as defined in claim 1, wherein said gas is a gas which has insulating properties similar to properties of sulfurhexafluoride.

10. A duct as defined in claim 1, wherein said gas is located under high pressure.

11. A duct as defined in claim 1, wherein said at least one insulating tube has a metallization, said at least one field control electrode being formed by said metallization.

12. A duct as defined in claim 1, wherein said duct is formed as a current transformer.

13. A duct as defined in claim 1, wherein said duct is formed as a voltage transformer.

14. A duct as defined in claim 1, wherein said duct is formed as a combined current and voltage transformer.

15. A duct for connecting an electrical device insulated with gas with a terminal location located in atmospheric air, the duct comprising a gas filled bushing insulator; at least one tubular field control electrode located inside said bushing insulator; at least one insulating tube having an end facing a potential-guiding region of the duct, said at least one field control electrode being formed by a conducting portion on said end of said at least one insulating tube; a bushing conductor around which said at least one insulating tube is arranged coaxially, said at lest one insulating tube having a ground potential-side end; a holder which holds said at least one insulating tube at said ground potential-side end on%side a region loaded with high field intensity; and a supporting pipe which surrounds said bushing conductor, said at least one insulating tube with said holder being held on said supporting pipe.

16. A duct for connecting an electrical device insulated with gas with a terminal location located in atmospheric air, the duct comprising a gas filled bushing insulator; at least one tubular field control electrode located inside said bushing insulator; first insulating tube having an end facing a potential-guiding region of the duct, said at least one field control electrode being formed by a conducting portion on said end of said first insulating tube; a bushing conductor around which said first first insulating tube is arranged coaxially, said insulating tube having a ground potential-side end; a holder which holds said first and second insulating tube at said ground potential-side end outside a region loaded with high field intensity; and a second such insulating tube, one of said insulating tubes having a greater diameter and being longer while another of said insulating tubes having a smaller diameter and is shorter.

17. A duct as defined in claim 15; and further comprising a conical mounting ring which is fixed on said supporting pipe and provided on said holder, said holder having an opening through which said mounting ring engages and which provides a fixing of said at least one insulating tube in an axial direction.

* * * * *